US009653036B2

(12) United States Patent
Zheng et al.

(10) Patent No.: US 9,653,036 B2
(45) Date of Patent: May 16, 2017

(54) METHOD AND SYSTEM FOR ADJUSTING GAMMA VOLTAGE, AND ELECTRONIC DEVICE

(71) Applicants: BOE TECHNOLOGY GROUP CO., LTD., Beijing (CN); HEFEI BOE OPTOELECTRONICS TECHNOLOGY CO., LTD, Hefei, Anhui (CN)

(72) Inventors: Liangliang Zheng, Beijing (CN); Jian He, Beijing (CN); Tingting Jin, Beijing (CN); Jiacheng Huang, Beijing (CN)

(73) Assignees: BOE TECHNOLOGY GROUP CO., LTD. (CN); HEFEI BOE OPTOELECTRONICS TECHNOLOGY CO., LTD. (CN)

( * ) Notice: Subject to any disclaimer, the term of this patent is extended or adjusted under 35 U.S.C. 154(b) by 477 days.

(21) Appl. No.: 14/368,020

(22) PCT Filed: Dec. 17, 2013

(86) PCT No.: PCT/CN2013/089621

§ 371 (c)(1),
(2) Date: Jun. 23, 2014

(87) PCT Pub. No.: WO2015/000270

PCT Pub. Date: Jan. 8, 2015

(65) Prior Publication Data

US 2016/0343340 A1 Nov. 24, 2016

(30) Foreign Application Priority Data

Jul. 5, 2013 (CN) ..... 2013 1 0282213

(51) Int. Cl.
*G09G 3/36* (2006.01)

(52) U.S. Cl.
CPC ..... *G09G 3/3696* (2013.01); *G09G 3/3607* (2013.01); *G09G 3/3648* (2013.01);
(Continued)

(58) Field of Classification Search
None
See application file for complete search history.

(56) References Cited

U.S. PATENT DOCUMENTS

2002/0158882 A1 10/2002 Liaw
2009/0244109 A1* 10/2009 Chen ..... G09G 3/3648 345/690

(Continued)

FOREIGN PATENT DOCUMENTS

CN 101211035 7/2008
CN 101937634 1/2011

(Continued)

OTHER PUBLICATIONS

Text of the Notification of the First Office Action, App. No. 2013102822133, Dec. 8, 2014.
International Search Report and Written Opinion issued in corresponding International Application No. PCT/CN2013/089621 dated Apr. 10, 2014.

*Primary Examiner* — Jennifer Mehmood
*Assistant Examiner* — Parul Gupta
(74) *Attorney, Agent, or Firm* — Brooks Kushman P.C.

(57) ABSTRACT

The method for adjusting a gamma voltage comprises: applying a reference common electrode voltage and a to-be-adjusted gamma voltage to a display module; collecting first light intensity data when the display module displays a grayscale test pattern after the reference common electrode voltage and the to-be-adjusted gamma voltage are applied; plotting a testing gamma curve in accordance with the first light intensity data; when the testing gamma curve is not located within the acceptable range of the standard gamma curve, adjusting the to-be-adjusted gamma voltage currently applied to the display module, until the testing gamma curve is located within the acceptable range of the standard gamma (Continued)

curve; and when the testing gamma curve is located within the acceptable range of the standard gamma curve, determining the to-be-adjusted gamma voltage currently applied to the display module as a final gamma voltage.

14 Claims, 8 Drawing Sheets

(52) U.S. Cl.
CPC ... *G09G 3/3688* (2013.01); *G09G 2320/0646* (2013.01); *G09G 2320/0673* (2013.01); *G09G 2330/021* (2013.01)

(56) References Cited

U.S. PATENT DOCUMENTS

2012/0120124 A1* 5/2012 Zhang ..... G09G 3/3648 345/690
2013/0120659 A1 5/2013 Park et al.

FOREIGN PATENT DOCUMENTS

| | | |
|---|---|---|
| CN | 102237052 | 11/2011 |
| CN | 103325357 | 9/2013 |
| JP | 2008145496 | 6/2008 |
| JP | 2008164849 | 7/2008 |

* cited by examiner

| | normally black mode | | normally white mode | |
|---|---|---|---|---|
| V1 | 252-255 | 63 | 0 | 0 |
| V2 | 189-251 | 49-62 | 1-4 | 1 |
| V3 | 125-188 | 33-48 | 5-60 | 2-16 |
| V4 | 61-124 | 17-32 | 61-124 | 17-32 |
| V5 | 5-60 | 2-16 | 125-188 | 33-48 |
| V6 | 1-4 | 1 | 189-251 | 49-62 |
| V7 | 0 | 0 | 252-255 | 63 |
| V8 | 0 | 0 | 252-255 | 63 |
| V9 | 1-4 | 1 | 189-251 | 49-62 |
| V10 | 5-60 | 2-16 | 125-188 | 33-48 |
| V11 | 61-124 | 17-32 | 61-124 | 17-32 |
| V12 | 125-188 | 33-48 | 5-60 | 2-16 |
| V13 | 189-251 | 49-62 | 1-4 | 1 |
| V14 | 252-255 | 63 | 0 | 0 |

Fig. 8

METHOD AND SYSTEM FOR ADJUSTING GAMMA VOLTAGE, AND ELECTRONIC DEVICE

CROSS-REFERENCE TO RELATED APPLICATION

This application is the U.S. national phase of PCT Application No. PCT/CN2013/089621 filed on Dec. 17, 2013, which claims priority to Chinese Patent Application No. 201310282213.3 filed on Jul. 5, 2013, the disclosures of which are incorporated in their entirety by reference herein.

TECHNICAL FIELD

The present invention relates to the field of display technology, in particular to a method and a system for adjusting a gamma voltage, and an electronic device.

BACKGROUND

Along with the rapid development of information technology and semiconductor technology, a thin film transistor liquid crystal display (TFT-LCD), which has such advantages as high display quality, high space utilization, low power consumption, no radiation and small volume, has been widely used. Since the human eyes' ability to identify brightness is not linear, Radio Frequency Signal Electronics Standards Institute has made a curve with a gamma value of 2.2 in accordance with the human eyes' characteristics, so as to facilitate the grayscale adjustment by a TFT-LCD designer, thereby to enable the TFT-LCD to present an image that is more suitable to the human visual characteristics.

Currently, there are mainly two methods for calibrating the gamma curve. 1) The accurate color capture (ACC) of a timing controller (TCON) may be adjusted so as to adjust a grayscale voltage across an LCD module (LCM) and test a grayscale-transmittance curve of the LCM, thereby to adjust a gamma value of the LCM. For this method, it is convenient to adjust the grayscale voltage across the LCM by adjusting the ACC of the TCON, but the adjustment range is limited and needs support from the manufacturers. As a result, it is adverse to the rapid development of the product, and the adjustment efficiency is low. 2) The divider resistance of several gamma voltages applied externally may be adjusted, so as to change the grayscale voltage across the LCM and test the grayscale-transmittance curve of the LCM, thereby to adjust the gamma value of the LCM. For this method, the LCM may be developed quickly by the original manufacturer, but due to the plurality of gamma voltages applied externally, it is very complex to adjust the resistance and the adjustment efficiency is low.

SUMMARY

An object of the present invention is to provide a method and a system for adjusting a gamma voltage, and an electronic device, so as to improve the adjustment efficiency of the external gamma voltage of an LCM.

In one aspect, the present invention provides a method for adjusting a gamma voltage, comprising the steps of:

applying a reference common electrode voltage and a to-be-adjusted gamma voltage to a display module;

collecting first light intensity data when the display module displays a grayscale test pattern after the reference common electrode voltage and the to-be-adjusted gamma voltage are applied;

plotting a testing gamma curve in accordance with the first light intensity data;

judging whether or not the testing gamma curve is located within an acceptable range of a standard gamma curve;

when the testing gamma curve is not located within the acceptable range of the standard gamma curve, adjusting the to-be-adjusted gamma voltage currently applied to the display module, until the testing gamma curve is located within the acceptable range of the standard gamma curve; and when the testing gamma curve is located within the acceptable range of the standard gamma curve, determining the to-be-adjusted gamma voltage currently applied to the display module as a final gamma voltage.

Alternatively, prior to the step of applying the reference common electrode voltage and the to-be-adjusted gamma voltage to the display module, the method further comprises:

applying a to-be-adjusted common electrode voltage and the to-be-adjusted gamma voltage to the display module;

collecting second light intensity data when the display module displays a flicker pattern after the to-be-adjusted common electrode voltage and the to-be-adjusted gamma voltage are applied;

judging whether or not the second light intensity data is located within a light intensity data range of a standard flicker pattern;

when the second light intensity data is not located within the light intensity data range of the standard flicker pattern, adjusting the to-be-adjusted common electrode voltage currently applied to the display module, until the second light intensity data is located within the light intensity data range of the standard flicker pattern; and when the second light intensity data is located within the light intensity data range of the standard flicker pattern, determining the to-be-adjusted common electrode voltage currently applied to the display module as the reference common electrode voltage.

Alternatively, prior to the step of applying the to-be-adjusting common electrode and the to-be-adjusted gamma voltage to the display module, the method further comprises:

acquiring the to-be-adjusted common electrode voltage by the equation $VCOM=[V(max)-V(min)]/2$, wherein VCOM represents the to-be-adjusted common electrode voltage, V(min) represents an absolute grayscale voltage of a minimum grayscale of the display module, and V(max) represents an absolute grayscale voltage of a maximum grayscale of the display module.

Alternatively, prior to the step of applying the reference common electrode voltage and the to-be-adjusted gamma voltage to the display module, the method further comprises:

acquiring the transmittance of a predetermined grayscale in accordance with a transmittance-grayscale curve of the display module $T=(Gray/((2^n)-1))^\gamma$, wherein T represents the transmittance, Gray represents the grayscale, n represents a color level of the display module, and $\gamma$ represents a gamma value of a standard gamma curve;

acquiring a voltage of the predetermined grayscale in accordance with the transmittance of the predetermined grayscale and a voltage-transmittance curve of the display module;

acquiring a voltage corresponding to the lowest transmittance and a voltage corresponding to the highest transmittance in accordance with the voltage-transmittance curve of the display module, and calculating a sum of the voltage corresponding to the lowest transmittance and the voltage corresponding to the highest transmittance, so as to obtain a center voltage of the display module; and generating the to-be-adjusted gamma voltage in accordance with the voltage of the predetermined grayscale and the center voltage.

Alternatively, the step of adjusting the to-be-adjusted common electrode voltage currently applied to the display module comprises:

increasing or decreasing the to-be-adjusted common electrode voltage currently applied to the display module by a first step value, to obtain a new to-be-adjusted common electrode voltage;

collecting the second light intensity data when the display module displays the flicker pattern after the new to-be-adjusted common electrode voltage and the to-be-adjusted gamma voltage are applied;

judging whether or not the second light intensity data collected currently is located within the light intensity data range of the standard flicker pattern;

when the second light intensity data collected currently is not within the light intensity data range of the standard flicker pattern, judging whether or not a difference between the second light intensity data collected currently and the light intensity data range of the standard flicker pattern is less than a difference between the second light intensity data collected previously and the light intensity data range of the standard flicker pattern, if yes, increasing or decreasing the to-be-adjusted common electrode voltage currently applied to the display module by the first step value in a manner identical to the previous adjustment, and if not, increasing or decreasing the to-be-adjusted common electrode voltage currently applied to the display module by the first step value in a manner contrary to the previous adjustment; and when the second light intensity data collected currently is located within the light intensity data range of the standard flicker pattern, determining the to-be-adjusted common electrode voltage currently applied to the display module as the reference common electrode voltage.

Alternatively, the step of plotting the gamma curve in accordance with the first light intensity data comprises:

acquiring maximum light intensity data and minimum light intensity data when the display module displays a maximum grayscale test pattern and a minimum grayscale test pattern;

acquiring a vertical coordinate data of the testing gamma curve by the equation: the vertical coordinate data=the minimum light intensity data+(the maximum light intensity data−the minimum light intensity data)*(a grayscale of a current grayscale test pattern/a maximum grayscale corresponding to the maximum grayscale test pattern)^γ, wherein γ represents the gamma value of the standard gamma curve; and plotting the testing gamma curve in accordance with the Y-axis coordinate data, an X-axis coordinate data of the gamma curve representing a grayscale value range of the display module.

Alternatively, the step of adjusting the to-be-adjusted gamma voltage currently applied to the display module comprises:

acquiring an abnormal grayscale corresponding to a point on the testing gamma curve that is not located within the acceptable range of the standard gamma curve;

acquiring an abnormal to-be-adjusted gamma voltage corresponding to the abnormal grayscale;

increasing or decreasing the abnormal to-be-adjusted gamma voltage by a second step value, to obtain a new to-be-adjusted gamma voltage;

collecting the first light intensity data when the display module displays the grayscale test pattern after the reference common electrode voltage and the new to-be-adjusted gamma voltage are applied;

plotting the testing gamma curve in accordance with the first light intensity data collected currently;

judging whether or not the testing gamma curve plotted currently is located within the acceptable range of the standard gamma curve;

when the testing gamma curve plotted currently is not located within the acceptable range of the standard gamma curve, continuing to adjust the abnormal to-be-adjusted gamma voltage, until the testing gamma curve plotted currently is located within the acceptable range of the standard gamma curve; and when the testing gamma curve plotted currently is located within the acceptable range of the standard gamma curve, determining the to-be-adjusted gamma voltage currently applied to the display module as the final gamma voltage.

In another aspect, the present invention provides a system for adjusting a gamma voltage, comprising:

a first applying unit configured to apply a reference common electrode voltage and a to-be-adjusted gamma voltage to a display module;

a first collecting unit configured to collect first light intensity data when the display module displays a grayscale test pattern after the reference common electrode voltage and the to-be-adjusted gamma voltage are applied;

a plotting unit configured to plot a testing gamma curve in accordance with the first light intensity data;

a first judging unit configured to judge whether or not the testing gamma curve is located within an acceptable range of a standard gamma curve;

a gamma voltage adjusting unit configured to, when the testing gamma curve is not located within the acceptable range of the standard gamma curve, adjust the to-be-adjusted gamma voltage currently applied to the display module, until the testing gamma curve is located within the acceptable range of the standard gamma curve; and a gamma voltage determining unit configured to, when the testing gamma curve is located within the acceptable range of the standard gamma curve, determining the to-be-adjusted gamma voltage currently applied to the display module as a final gamma voltage.

Alternatively, the system for adjusting the gamma voltage further comprises:

a second applying unit configured to apply a to-be-adjusted common electrode voltage and the to-be-adjusted gamma voltage to the display module;

a second collecting unit configured to collect second light intensity data when the display module displays a flicker pattern after the to-be-adjusted common electrode voltage and the to-be-adjusted gamma voltage are applied;

a second judging unit configured to judge whether or not the second light intensity data is located within a light intensity data range of a standard flicker pattern;

a common electrode voltage adjusting unit configured to, when the second light intensity data is not located within the light intensity data range of the standard flicker pattern, adjust the to-be-adjusted common electrode voltage currently applied to the display module, until the second light intensity data is located within the light intensity data range of the standard flicker pattern; and a common electrode voltage determining unit configured to, when the second light intensity data is located within the light intensity data range of the standard flicker pattern, determine the to-be-adjusted common electrode voltage currently applied to the display module as the reference common electrode voltage.

Alternatively, the system for adjusting the gamma voltage further comprises:

an initial common electrode voltage acquiring unit configured to acquire the to-be-adjusted common electrode voltage by the equation VCOM=[V(max)−V(min)]/2, wherein VCOM represents the to-be-adjusted common electrode voltage, V(min) represents an absolute grayscale voltage of a minimum grayscale of the display module, and V(max) represents an absolute grayscale voltage of a maximum grayscale of the display module.

Alternatively, the system for adjusting the gamma voltage further comprises:

a transmittance acquiring unit configured to acquire the transmittance of a predetermined grayscale in accordance with a transmittance-grayscale curve of the display module T=(Gray/((2^n)−1))^γ, wherein T represents the transmittance, Gray represents the grayscale, n represents a color level of the display module, and γ represents a gamma value of a standard gamma curve;

a voltage acquiring unit configured to acquire a voltage of the predetermined grayscale in accordance with the transmittance of the predetermined grayscale and a voltage-transmittance curve of the display module;

a center voltage acquiring unit configured to acquire a voltage corresponding to the lowest transmittance and a voltage corresponding to the highest transmittance in accordance with the voltage-transmittance curve of the display module, and calculate a sum of the voltage corresponding to the lowest transmittance and the voltage corresponding to the highest transmittance, so as to obtain a center voltage of the display module; and a gamma voltage generating unit configured to generate the to-be-adjusted gamma voltage in accordance with the voltage of the predetermined grayscale and the center voltage.

Alternatively, the common electrode voltage adjusting unit comprises:

a first adjusting sub-unit configured to increase or decrease the to-be-adjusted common electrode voltage currently applied to the display module by a first step value, to obtain a new to-be-adjusted common electrode voltage, and transmit the new to-be-adjusted common electrode voltage to the first applying unit;

a first judging sub-unit configured to judge whether or not the second light intensity data collected currently when the display module displays the flicker pattern after the new to-be-adjusted common electrode voltage and the to-be-adjusted gamma voltage are applied is located within the light intensity data range of the standard flicker pattern;

a second adjusting sub-unit configured to, when the second light intensity data collected currently is not within the light intensity data range of the standard flicker pattern, judge whether or not a difference between the second light intensity data collected currently and the light intensity data range of the standard flicker pattern is less than a difference between the second light intensity data collected previously and the light intensity data range of the standard flicker pattern, if yes, increase or decrease the to-be-adjusted common electrode voltage currently applied to the display module by the first step value in a manner identical to the previous adjustment, and if not, increase or decrease the to-be-adjusted common electrode voltage currently applied to the display module by the first step value in a manner contrary to the previous adjustment; and a first determining sub-unit configured to, when the second light intensity data collected currently is located within the light intensity data range of the standard flicker pattern, determine the to-be-adjusted common electrode voltage currently applied to the display module as the reference common electrode voltage.

Alternatively, the plotting unit comprises:

a first acquiring sub-unit configured to acquire maximum light intensity data and minimum light intensity data when the display module displays a maximum grayscale test pattern and a minimum grayscale test pattern;

a second acquiring sub-unit configured to acquire a vertical coordinate data of the testing gamma curve by the following equation: the vertical coordinate data=the minimum light intensity data+(the maximum light intensity data−the minimum light intensity data)*(a grayscale of a current grayscale test pattern/a maximum grayscale corresponding to the maximum grayscale test pattern)^γ, wherein γ represents the gamma value of the standard gamma curve; and a first plotting sub-unit configured to plot the testing gamma curve in accordance with the vertical coordinate data, wherein a horizontal coordinate data of the gamma curve represents a grayscale value range of the display module.

Alternatively, the gamma voltage adjusting unit comprises:

a third acquiring sub-unit configured to acquire an abnormal grayscale corresponding to a point on the testing gamma curve that is not located within the acceptable range of the standard gamma curve;

a fourth acquiring sub-unit configured to acquire an abnormal to-be-adjusted gamma voltage corresponding to the abnormal grayscale;

a third adjusting sub-unit configured to increase or decrease the abnormal to-be-adjusted gamma voltage by a second step value to obtain a new to-be-adjusted gamma voltage, and transmit the new to-be-adjusted gamma voltage to the first applying unit;

a second plotting sub-unit configured to plot the testing gamma curve in accordance with the first light intensity data collected when the display module displays the grayscale test pattern after the reference common electrode voltage and the new to-be-adjusted gamma voltage are applied;

a second judging sub-unit configured to judge whether or not the testing gamma curve plotted currently is located within the acceptable range of the standard gamma curve;

a fourth adjusting sub-unit configured to, when the testing gamma curve plotted currently is not located within the acceptable range of the standard gamma curve, continue to adjust the abnormal to-be-adjusted gamma voltage, until the testing gamma curve plotted currently is located within the acceptable range of the standard gamma curve; and a second determining sub-unit configured to, when the testing gamma curve plotted currently is located within the acceptable range of the standard gamma curve, determine the to-be-adjusted gamma voltage currently applied to the display module as the final gamma voltage.

In yet another aspect, the present disclosure provides an electronic device comprising the above-mentioned system for adjusting the gamma voltage.

According to the present disclosure, it is able to automatically test the gamma characteristics of the display module in accordance with the plotted gamma curve, thereby to dynamically adjust the gamma voltage of the display module applied externally and adjust the gamma curve of the display module to be within the predetermined range. As a result, it is able to improve the efficiency of testing the gamma characteristics of the display module, shorten the driver development cycle, and reduce the development cost.

BRIEF DESCRIPTION OF THE DRAWINGS

FIG. 8 is a correspondence table showing a gamma voltage and a grayscale according to the eighth embodiment of the present invention;

DETAILED DESCRIPTION

The present invention will be described hereinafter in conjunction with the drawings and the embodiments.

First Embodiment

Figure 1:
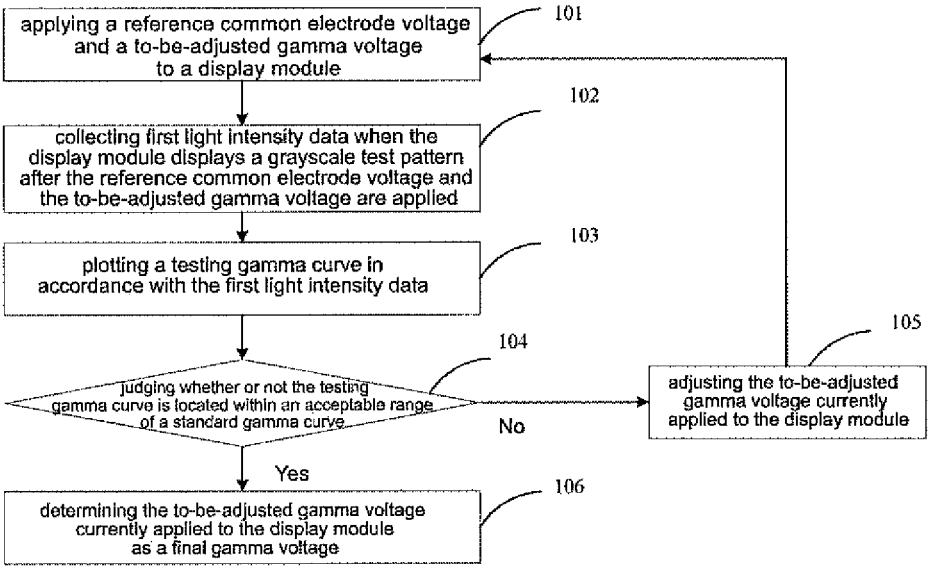
FIG. 1 is a flow chart of a method for adjusting a gamma voltage according to the first embodiment of the present invention.

Referring to FIG. 1, which is a flow chart of a method for adjusting a gamma voltage according to the first embodiment of the present invention, the method comprises the following steps.

Step 101: applying a reference common electrode voltage and a to-be-adjusted gamma voltage to a display module. In this embodiment, the display module may be an LCM.

Step 102: collecting first light intensity data when the display module displays a grayscale test pattern after the reference common electrode voltage and the to-be-adjusted gamma voltage are applied. In this embodiment, the grayscale test pattern includes the pattern corresponding to a plurality of predetermined grayscales. For example, when a grayscale value of the display module is ranged from 0 to 63, the plurality of predetermined grayscales are 0, 1, 16, 32, 48, 62 and 63, and when the grayscale value of the display module is ranged from 0 to 255, the plurality of predetermined grayscales are 0, 4, 60, 124, 188, 251 and 255.

Step 103: plotting a testing gamma curve in accordance with the first light intensity data.

Step 104: judging whether or not the testing gamma curve is located within an acceptable range of a standard gamma curve, if yes, proceeding to step 106, and otherwise, proceeding to step 105. The acceptable range of the standard gamma curve may be set in accordance with the practical need. For example, when the standard gamma curve has a gamma value of 2.2, the testing gamma curve being located within the acceptable range of the standard gamma curve may refer to that all points on the testing gamma curve are located between a gamma curve having a gamma value of 2.1 and a gamma curve having a gamma value of 2.3.

Step 105: when the testing gamma curve is not located within the acceptable range of the standard gamma curve, adjusting the to-be-adjusted gamma voltage currently applied to the display module, so as to obtain a new to-be-adjusted gamma voltage, and then returning to step 101.

Step 106: when the testing gamma curve is located within the acceptable range of the standard gamma curve, determining the to-be-adjusted gamma voltage currently applied to the display module as a final gamma voltage.

According to the method of this embodiment, it is able to automatically test the gamma characteristics of the display module in accordance with the plotted gamma curve, thereby to dynamically adjust the gamma voltage applied externally from the display module and adjust the gamma curve of the display module to be within the predetermined range. As a result, it is able to improve the efficiency of testing the gamma characteristics of the display module, shorten the driver development cycle, and reduce the development cost.

Second Embodiment

Figure 2:
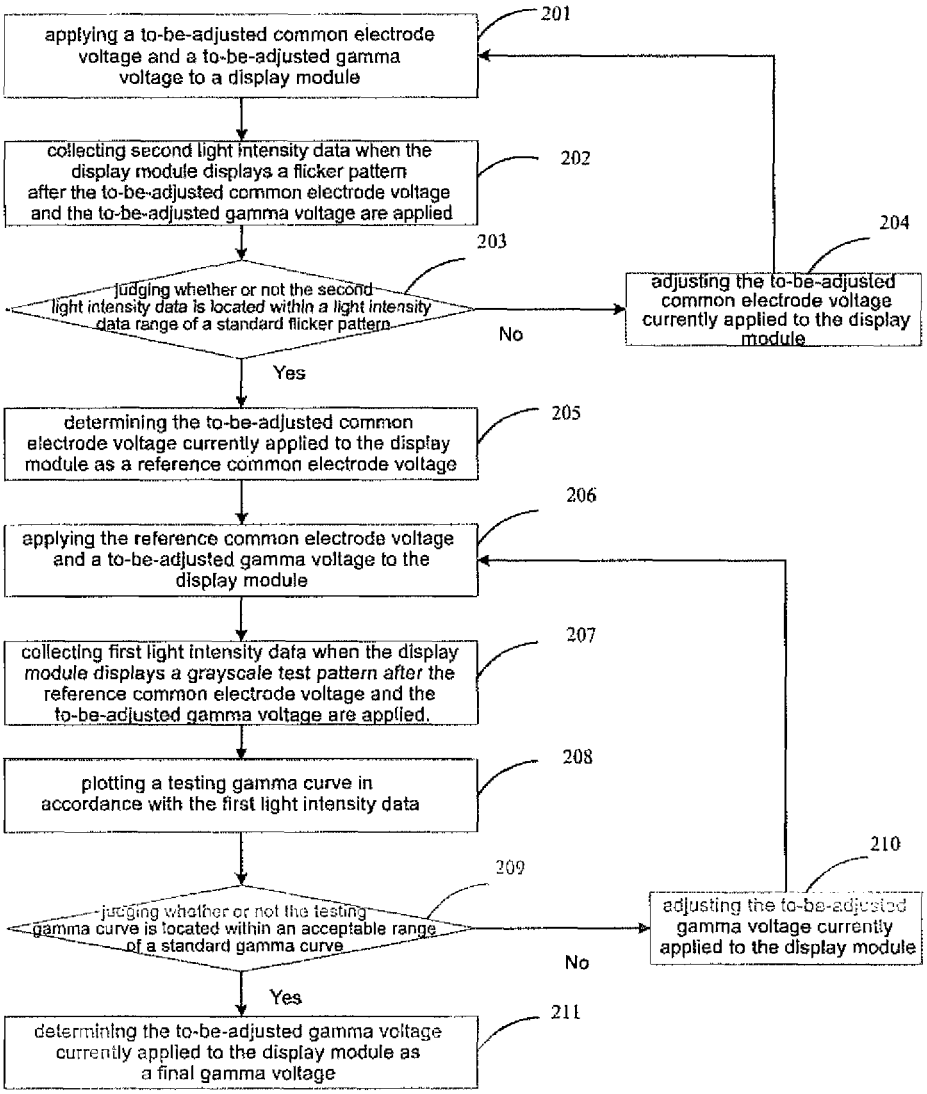
FIG. 2 is a flow chart of a method for adjusting a gamma voltage according to the second embodiment of the present invention.

Referring to FIG. 2, which is a flow chart of a method for adjusting a gamma voltage according to the second embodiment of the present invention, the method comprises the following steps.

Step 201: applying a to-be-adjusted common electrode voltage and a to-be-adjusted gamma voltage to a display module. In this embodiment, the display module may be an LCM.

Step 202: collecting second light intensity data when the display module displays a flicker pattern after the to-be-adjusted common electrode voltage and the to-be-adjusted gamma voltage are applied.

Step 203: judging whether or not the second light intensity data is located within a light intensity data range of a standard flicker pattern, if yes, proceeding to step 205, and otherwise, proceeding to step 204.

Step 204: when the second light intensity data is not located within the light intensity data range of the standard flicker pattern, adjusting the to-be-adjusted common electrode voltage currently applied to the display module so as to obtain a new to-be-adjusted common electrode voltage, and then returning to step 201.

Step 205: when the second light intensity data is located within the light intensity data range of the standard flicker pattern, determining the to-be-adjusted common electrode voltage currently applied to the display module as a reference common electrode voltage.

Step 206: applying the reference common electrode voltage and a to-be-adjusted gamma voltage to the display module.

Step 207: collecting first light intensity data when the display module displays a grayscale test pattern after the reference common electrode voltage and the to-be-adjusted gamma voltage are applied.

Step 208: plotting a testing gamma curve in accordance with the first light intensity data.

Step 209: judging whether or not the testing gamma curve is located within an acceptable range of a standard gamma curve, if yes, proceeding to step 211, and otherwise, proceeding to step 210.

Step 210: when the testing gamma curve is not located within the acceptable range of the standard gamma curve, adjusting the to-be-adjusted gamma voltage currently applied to the display module so as to obtain a new to-be-adjusted gamma voltage, and then returning to step 206.

Step 211: when the testing gamma curve is located within the acceptable range of the standard gamma curve, determining the to-be-adjusted gamma voltage currently applied to the display module as a final gamma voltage.

According to the method of this embodiment, it is able to automatically test and adjust a flickering mode of the display module, thereby to obtain the reference common electrode voltage of the display module.

Of course, in other embodiments of the present invention, the reference common electrode voltage of the display module may be acquired through other methods.

In this embodiment, the initial to-be-adjusted gamma voltage applied to the display module may be acquired by acquiring the transmittance of a predetermined grayscale in accordance with a transmittance-grayscale curve of the display module $T=(Gray/((2^n)-1)^\gamma$, wherein T represents the transmittance, Gray represents the grayscale, n represents a color level of the display module, and $\gamma$ represents a gamma value of a standard gamma curve (for example, when a grayscale value of the display module is ranged from 0 to 63, the predetermined grayscales are 0, 1, 16, 32, 48, 62 and 63, and when the grayscale value of the display module is ranged from 0 to 255, the predetermined grayscales are 0, 4, 60, 124, 188, 251 and 255);

acquiring a voltage V(G) of the predetermined grayscale in accordance with the transmittance of the predetermined grayscale and a voltage-transmittance curve (V-T) of the display module;

acquiring a voltage corresponding to the lowest transmittance and a voltage corresponding to the highest transmittance in accordance with the voltage-transmittance curve of the display module, and calculating a sum of the voltage corresponding to the lowest transmittance and the voltage corresponding to the highest transmittance, so as to obtain a center voltage Vcenter of the display module; and generating the to-be-adjusted gamma voltage in accordance with the voltage of the predetermined grayscale and the center voltage, wherein the to-be-adjusted gamma voltage $V(m)=Vcenter\pm V(G)$.

In this embodiment, the initial to-be-adjusted common electrode voltage applied to the display module may be calculated by the equation $VCOM=[V(max)-V(min)]/2$, wherein VCOM represents the to-be-adjusted common electrode voltage, V(min) represents an absolute grayscale voltage of a minimum grayscale of the display module, and V(max) represents an absolute grayscale voltage of a maximum grayscale of the display module.

In this embodiment, the gamma curve may be plotted by:

acquiring maximum light intensity data and minimum light intensity data when the display module displays a maximum grayscale test pattern and a minimum grayscale test pattern, respectively;

acquiring a vertical coordinate data of the testing gamma curve by the following equation: the vertical coordinate data=the minimum light intensity data+(the maximum light intensity data−the minimum light intensity data)*(a grayscale of a current grayscale test pattern/a maximum grayscale corresponding to the maximum grayscale test pattern)$^\gamma$, wherein $\gamma$ represents the gamma value of the standard gamma curve; and plotting the testing gamma curve in accordance with the vertical coordinate data, wherein a horizontal coordinate data of the gamma curve represents a grayscale value range of the display module.

In this embodiment, the grayscale test pattern includes a grayscale test pattern corresponding to a plurality of predetermined grayscales. For example, when the grayscale value of the display module is ranged from 0 to 63, the plurality of predetermined grayscales are 0, 1, 16, 32, 48, 62 and 63, and when the grayscale value of the display module is ranged from 0 to 255, the plurality of predetermined grayscales are 0, 4, 60, 124, 188, 251 and 255.

Third Embodiment

Figure 3:
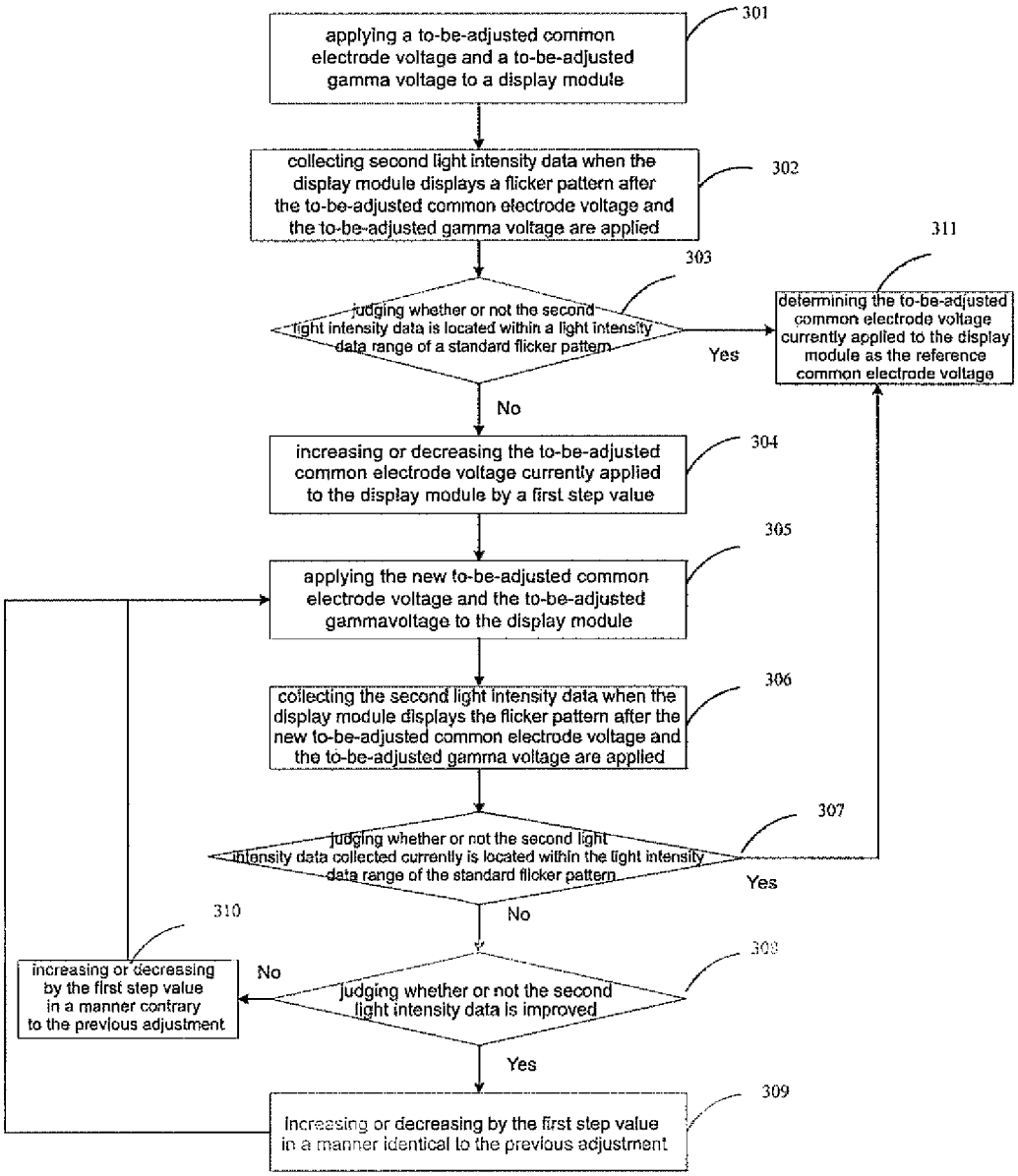
FIG. 3 is a flow chart of a method for adjusting a common electrode voltage according to the third embodiment of the present invention.

Referring to FIG. 3, which is a flow chart of a method for adjusting a common electrode voltage according to the third embodiment of the present invention, the method comprises:

step 301: applying a to-be-adjusted common electrode voltage and a to-be-adjusted gamma voltage to a display module;

step 302: collecting second light intensity data when the display module displays a flicker pattern after the to-be-adjusted common electrode voltage and the to-be-adjusted gamma voltage are applied;

step 303: judging whether or not the second light intensity data is located within a light intensity data range of a standard flicker pattern, if yes, proceeding to step 311, and otherwise, proceeding to step 304;

step 304: when the second light intensity data is not located within the light intensity data range of the standard flicker pattern, increasing or decreasing the to-be-adjusted common electrode voltage currently applied to the display module by a first step value, so as to obtain a new to-be-adjusted common electrode voltage;

step 305: applying the new to-be-adjusted common electrode voltage and the to-be-adjusted gamma voltage to the display module;

step 306: collecting the second light intensity data when the display module displays the flicker pattern after the new to-be-adjusted common electrode voltage and the to-be-adjusted gamma voltage are applied;

step 307: judging whether or not the second light intensity data collected currently is located within the light intensity data range of the standard flicker pattern, if yes, proceeding to step 311, and otherwise, proceeding to step 308;

step 308: when the second light intensity data collected currently is not within the light intensity data range of the standard flicker pattern, judging whether or not a difference between the second light intensity data collected currently and the light intensity data range of the standard flicker pattern is less than a difference between the second light intensity data collected previously and the light intensity data range of the standard flicker pattern (i.e., whether or not the second light intensity data is improved), if yes, proceeding to step 309, and otherwise, proceeding to step 310; step 309: increasing or decreasing the to-be-adjusted common electrode voltage currently applied to the display module by the first step value in a manner identical to the previous adjustment so as to obtain the new to-be-adjusted common electrode voltage, and then returning to step 305;

step 310: increasing or decreasing the to-be-adjusted common electrode voltage currently applied to the display module by the first step value in a manner contrary to the previous adjustment so as to obtain the new to-be-adjusted common electrode voltage, and then returning to step 305; and step 311: when the second light intensity data collected currently is located within the light intensity data range of the standard flicker pattern, determining the to-be-adjusted common electrode voltage currently applied to the display module as the reference common electrode voltage.

Fourth Embodiment

Figure 4:
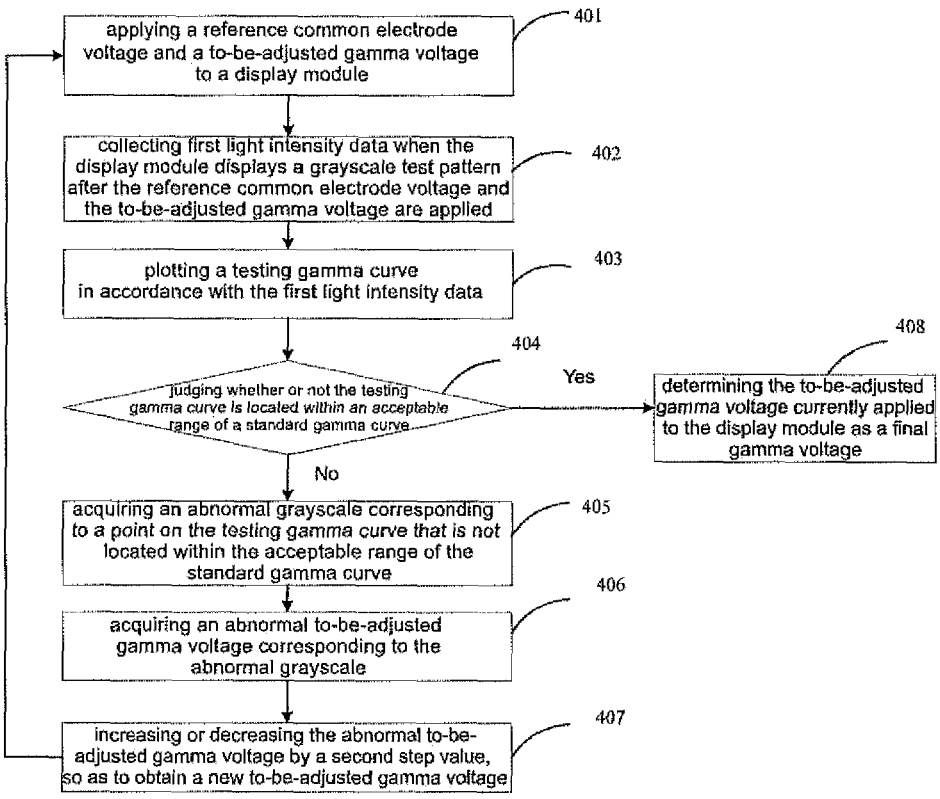
FIG. 4 is a flow chart of a method for adjusting a gamma voltage according to the fourth embodiment of the present invention.

Referring to FIG. 4, which is a flow chart of a method for adjusting a gamma voltage according to the fourth embodiment of the present invention, the method comprises:

step 401: applying a reference common electrode voltage and a to-be-adjusted gamma voltage to a display module;

step 402: collecting first light intensity data when the display module displays a grayscale test pattern after the reference common electrode voltage and the to-be-adjusted gamma voltage are applied;

step 403: plotting a testing gamma curve in accordance with the first light intensity data;

step 404: judging whether or not the testing gamma curve is located within an acceptable range of a standard gamma curve, if yes, proceeding to step 408, and otherwise, proceeding to step 405;

step 405: when the testing gamma curve is not located within the acceptable range of the standard gamma curve, acquiring an abnormal grayscale corresponding to a point on the testing gamma curve that is not located within the acceptable range of the standard gamma curve;

step 406: acquiring an abnormal to-be-adjusted gamma voltage corresponding to the abnormal grayscale;

step 407: increasing or decreasing the abnormal to-be-adjusted gamma voltage by a second step value, so as to obtain a new to-be-adjusted gamma voltage, and returning to step 401; and step 408: when the testing gamma curve plotted currently is located within the acceptable range of the standard gamma curve, determining the to-be-adjusted gamma voltage currently applied to the display module as a final gamma voltage.

Fifth Embodiment

Figure 5:
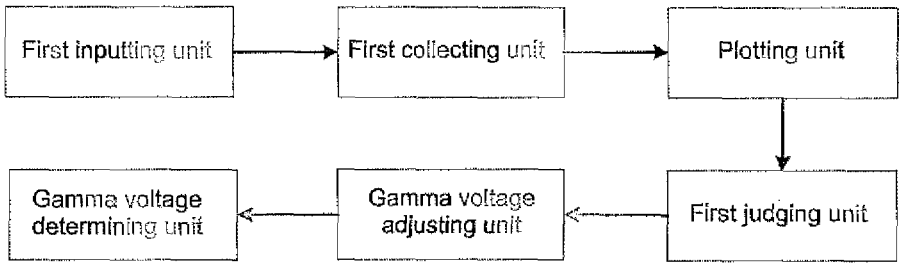
FIG. 5 is a block diagram showing a system for adjusting a gamma voltage according to the fifth embodiment of the present invention.

Referring to FIG. 5, which is a block diagram showing a system for adjusting a gamma voltage according to the fifth embodiment of the present invention, the system comprises:

a first applying unit configured to apply a reference common electrode voltage and a to-be-adjusted gamma voltage to a display module;

a first collecting unit configured to collect first light intensity data when the display module displays a grayscale test pattern after the reference common electrode voltage and the to-be-adjusted gamma voltage are applied;

a plotting unit configured to plot a testing gamma curve in accordance with the first light intensity data;

a first judging unit configured to judge whether or not the testing gamma curve is located within an acceptable range of a standard gamma curve;

a gamma voltage adjusting unit configured to, when the testing gamma curve is not located within the acceptable range of the standard gamma curve, adjust the to-be-adjusted gamma voltage currently applied to the display module, until the testing gamma curve is located within the acceptable range of the standard gamma curve; and a gamma voltage determining unit configured to, when the testing gamma curve is located within the acceptable range of the standard gamma curve, determining the to-be-adjusted gamma voltage currently applied to the display module as a final gamma voltage.

According to the system of this embodiment, it is able to automatically test the gamma characteristics of the display module in accordance with the plotted gamma curve, thereby to dynamically adjust the gamma voltage of the display module applied externally and adjust the gamma curve of the display module to be within the predetermined range. As a result, it is able to improve the efficiency of testing the gamma characteristics of the display module, shorten the driver development cycle, and reduce the development cost.

Sixth Embodiment

On the basis of the embodiment as shown in FIG. 5, the system for adjusting the gamma voltage according to the sixth embodiment of the present invention further comprises:

a second applying unit configured to apply a to-be-adjusted common electrode voltage and the to-be-adjusted gamma voltage to the display module;

a second collecting unit configured to collect second light intensity data when the display module displays a flicker pattern after the to-be-adjusted common electrode voltage and the to-be-adjusted gamma voltage are applied;

a second judging unit configured to judge whether or not the second light intensity data is located within a light intensity data range of a standard flicker pattern;

a common electrode voltage adjusting unit configured to, when the second light intensity data is not located within the light intensity data range of the standard flicker pattern, adjust the to-be-adjusted common electrode voltage currently applied to the display module, until the second light intensity data is located within the light intensity data range of the standard flicker pattern; and a common electrode voltage determining unit configured to, when the second light intensity data is located within the light intensity data range of the standard flicker pattern, determine the to-be-adjusted common electrode voltage currently applied to the display module as the reference common electrode voltage.

According to the system of this embodiment, it is able to automatically test and adjust a flickering mode of the display module, thereby to obtain the reference common electrode voltage of the display module.

In order to acquire the initial to-be-adjusted gamma voltage and the initial to-be-adjusted common electrode voltage, the system may further comprise:

an initial common electrode voltage acquiring unit configured to acquire the to-be-adjusted common electrode voltage by the equation $VCOM=[V(max)-V(min)]/2$, wherein VCOM represents the to-be-adjusted common electrode voltage, V(min) represents an absolute grayscale voltage of a minimum grayscale of the display module, and V(max) represents an absolute grayscale voltage of a maximum grayscale of the display module;

a transmittance acquiring unit configured to acquire the transmittance of a predetermined grayscale in accordance with a transmittance-grayscale curve of the display module $T=(Gray/((2^n)-1))^\gamma$, wherein T represents the transmittance, Gray represents the grayscale, n represents a color level of the display module, and $\gamma$ represents a gamma value of a standard gamma curve;

a voltage acquiring unit configured to acquire a voltage of the predetermined grayscale in accordance with the transmittance of the predetermined grayscale and a voltage-transmittance curve of the display module;

a center voltage acquiring unit configured to acquire a voltage corresponding to the lowest transmittance and a voltage corresponding to the highest transmittance in accordance with the voltage-transmittance curve of the display module, and calculate a sum of the voltage corresponding to the lowest transmittance and the voltage corresponding to the highest transmittance, so as to obtain a center voltage of the display module; and a gamma voltage generating unit configured to generate the to-be-adjusted gamma voltage in accordance with the voltage of the predetermined grayscale and the center voltage.

In this embodiment, in order to adjust the common electrode voltage, the common electrode voltage adjusting unit may comprise:

a first adjusting sub-unit configured to increase or decrease the to-be-adjusted common electrode voltage currently applied to the display module by a first step value, to obtain a new to-be-adjusted common electrode voltage, and transmitting the new to-be-adjusted common electrode voltage to the first applying unit;

a first judging sub-unit configured to judge whether or not the second light intensity data collected currently when the display module displays the flicker pattern after the new to-be-adjusted common electrode voltage and the to-be-adjusted gamma voltage are applied is located within the light intensity data range of the standard flicker pattern;

a second adjusting sub-unit configured to, when the second light intensity data collected currently is not within the light intensity data range of the standard flicker pattern, judge whether or not a difference between the second light intensity data collected currently and the light intensity data range of the standard flicker pattern is less than a difference between the second light intensity data collected previously and the light intensity data range of the standard flicker pattern, if yes, increase or decrease the to-be-adjusted common electrode voltage currently applied to the display module by the first step value in a manner identical to the previous adjustment, and if not, increase or decrease the to-be-adjusted common electrode voltage currently applied to the display module by the first step value in a manner contrary to the previous adjustment; and a first determining sub-unit configured to, when the second light intensity data collected currently is located within the light intensity data range of the standard flicker pattern, determine the to-be-adjusted common electrode voltage currently applied to the display module as the reference common electrode voltage.

In this embodiment, in order to plot the gamma curve, the plotting unit may comprise:

a first acquiring sub-unit configured to acquire maximum light intensity data and minimum light intensity data when the display module displays a maximum grayscale test pattern and a minimum grayscale test pattern, respectively;

a second acquiring sub-unit configured to acquire a vertical coordinate data of the testing gamma curve by the following equation: the vertical coordinate data=the minimum light intensity data+(the maximum light intensity data−the minimum light intensity data)*(a grayscale of a current grayscale test pattern/a maximum grayscale corresponding to the maximum grayscale test pattern)^γ, wherein γ represents the gamma value of the standard gamma curve; and a first plotting sub-unit configured to plot the testing gamma curve in accordance with the vertical coordinate data, wherein a horizontal coordinate data of the gamma curve represent a grayscale value range of the display module.

In this embodiment, in order to adjust the gamma voltage, the gamma voltage adjusting unit may comprise:

a third acquiring sub-unit configured to acquire an abnormal grayscale corresponding to a point on the testing gamma curve that is not located within the acceptable range of the standard gamma curve;

a fourth acquiring sub-unit configured to acquire an abnormal to-be-adjusted gamma voltage corresponding to the abnormal grayscale;

a third adjusting sub-unit configured to increase or decrease the abnormal to-be-adjusted gamma voltage by a second step value to obtain a new to-be-adjusted gamma voltage, and transmit the new to-be-adjusted gamma voltage to the first applying unit;

a second plotting sub-unit configured to plot the testing gamma curve in accordance with the first light intensity data collected when the display module displays the grayscale test pattern after the reference common electrode voltage and the new to-be-adjusted gamma voltage are applied;

a second judging sub-unit configured to judge whether or not the testing gamma curve plotted currently is located within the acceptable range of the standard gamma curve;

a fourth adjusting sub-unit configured to, when the testing gamma curve plotted currently is not located within the acceptable range of the standard gamma curve, continue to adjust the abnormal to-be-adjusted gamma voltage, until the testing gamma curve plotted currently is located within the acceptable range of the standard gamma curve; and a second determining sub-unit configured to, when the testing gamma curve plotted currently is located within the acceptable range of the standard gamma curve, determine the to-be-adjusted gamma voltage currently applied to the display module as the final gamma voltage.

Seventh Embodiment

The present invention further provides an electronic device comprising the system for adjusting the gamma voltage according to any one of the above-mentioned embodiments.

Eighth Embodiment

Figure 6:
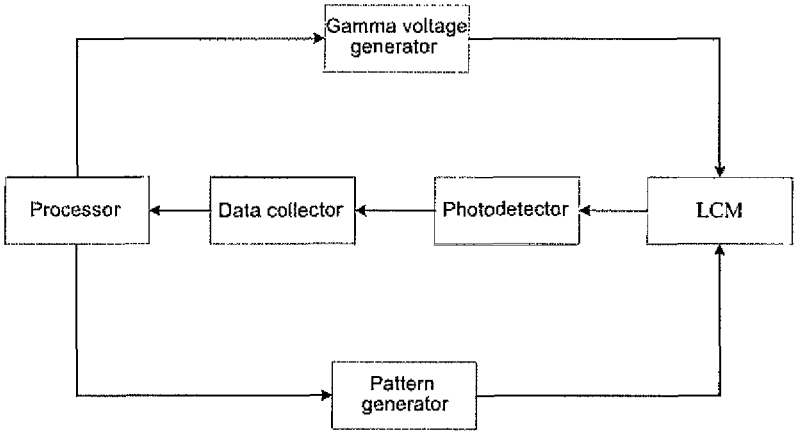
FIG. 6 is a block diagram showing a system for adjusting a gamma voltage according to the eighth embodiment of the present invention.

Referring to FIG. 6, which is a block diagram showing a system for adjusting a gamma voltage according to the eighth embodiment of the present invention, the system comprises a processor (e.g., a PC), a gamma voltage generator, an LCM, a photodetector, a data collector and a pattern generator.

The processor is configured to acquire a current to-be-adjusted gamma voltage and a current to-be-adjusted common electrode voltage, and apply the current to-be-adjusted gamma voltage and the current to-be-adjusted common electrode voltage to the gamma voltage generator.

The gamma voltage generator is configured to apply the current to-be-adjusted common electrode voltage and the current to-be-adjusted gamma voltage to the LCM.

The photodetector and the data collector are configured to collect second light intensity data when the LCM displays a flicker pattern after the to-be-adjusted common electrode voltage and the to-be-adjusted gamma voltage are applied.

The processor is further configured to judge whether or not the second light intensity data collected currently is located within a light intensity data range of a standard flicker pattern, if yes, determine the to-be-adjusted common electrode voltage currently applied to the LCM as a reference common electrode voltage, and if not, adjust the to-be-adjusted common electrode voltage to obtain a new to-be-adjusted common electrode voltage and apply the new to-be-adjusted common electrode voltage to the gamma voltage generator.

The photodetector and the data collector are further configured to collect first light intensity data when the display module displays a grayscale test pattern after the reference common electrode voltage and the to-be-adjusted gamma voltage are applied.

The processor is further configured to plot a testing gamma curve in accordance with the first light intensity data collected currently, judge whether or not the testing gamma curve is located within an acceptable range of a standard gamma curve, if yes, determine the to-be-adjusted gamma voltage currently applied to the display module as a final gamma voltage, and if not, adjust the to-be-adjusted gamma voltage so as to obtain a new to-be-adjusted gamma voltage, and apply the new to-be-adjusted gamma voltage to the gamma voltage generator.

Figure 7:
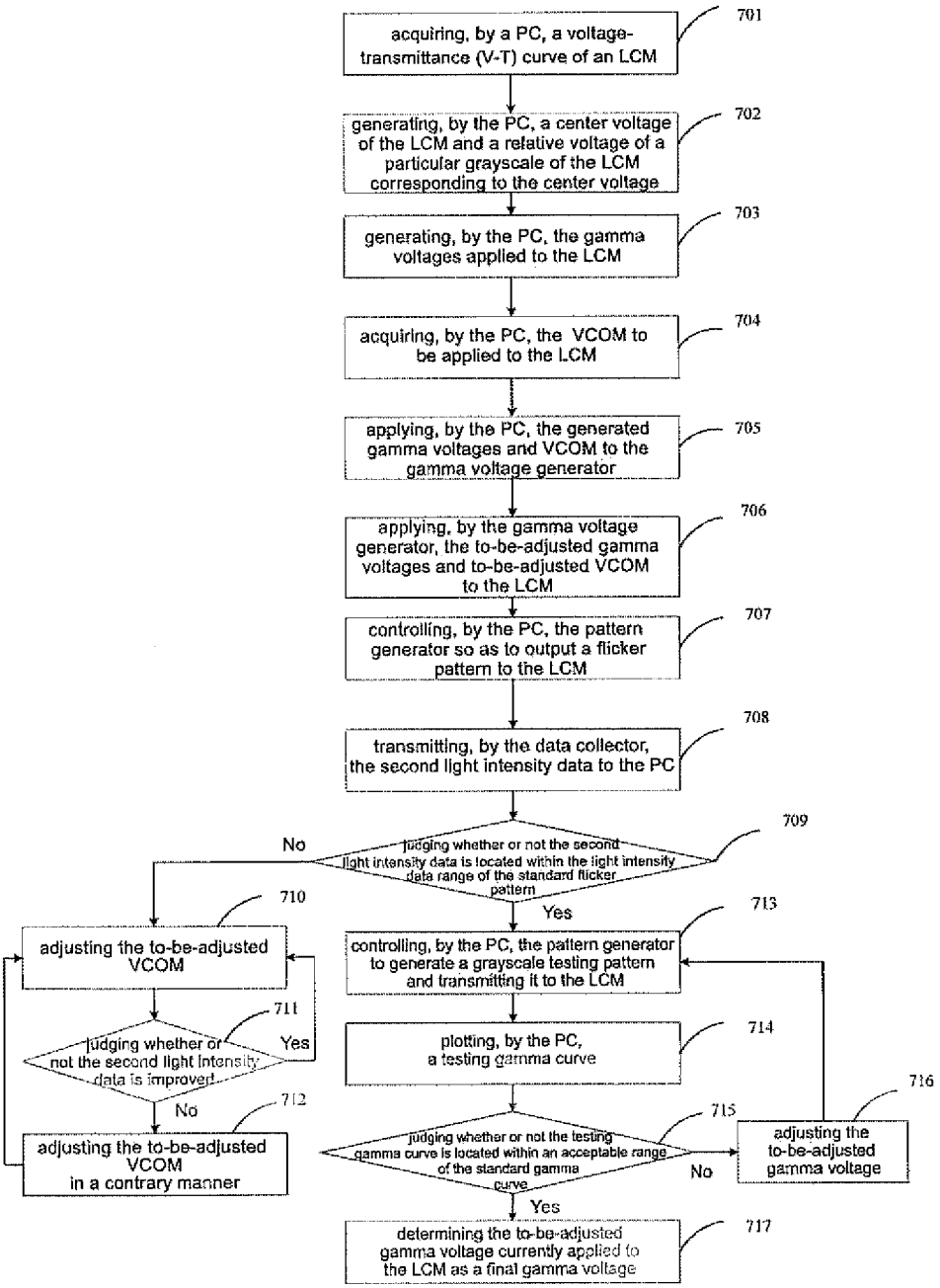
FIG. 7 is a workflow chart of the system for adjusting the gamma voltage according to the eighth embodiment of the present invention.

Referring to FIG. 7, which is a workflow chart of the system for adjusting the gamma voltage according to the eighth embodiment of the present invention, the workflow of the system may comprise the following steps by taking the processor being a PC as an example.

Figure 9:
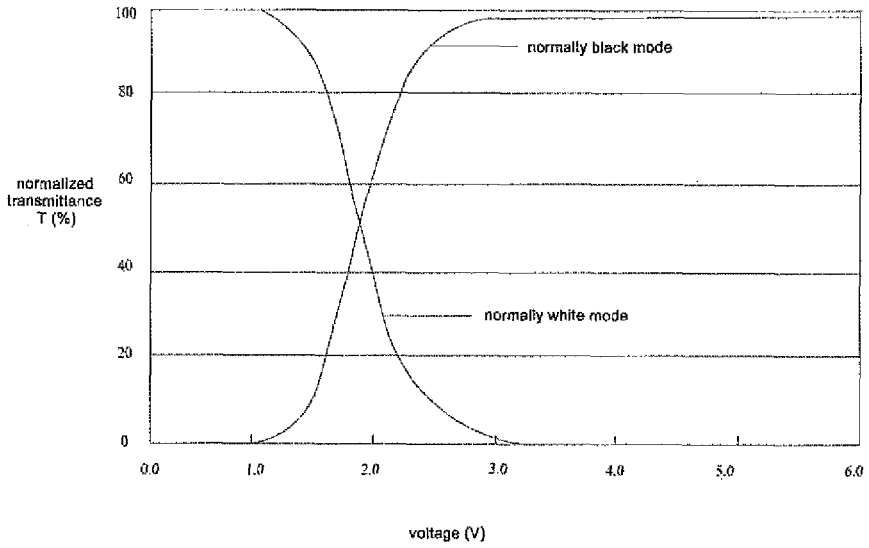
FIG. 9 is a schematic view showing a voltage-transmittance curve of an LCM according to the eighth embodiment of the present invention.

Step 701: acquiring, by the PC, a voltage-transmittance (V-T) curve of the LCM. In this embodiment, the PC may extract the V-T curve data of the LCM, and performs nonlinear fitting on the V-T curve data so as to obtain the V-T curve of the LCM T=f(Vi), wherein f( ) represents a fitting function that is associated with the particular LCM, and Vi represents absolute grayscale voltages of different grayscales of the LCM. For the LCMs with different color levels, the value range of i may be different. For example, for an LCM with a 6-bit color level, i is ranged from 0 to 63, while for an LCM with an 8-bit color level, i is ranged from 0 to 255. FIG. 9 is a schematic view showing the voltage-transmittance curve of the LCM according to the eighth embodiment of the present invention.

Step 702: generating, by the PC, a center voltage Vcenter and a voltage V(G) of a predetermined grayscale of the LCM in accordance with the V-T curve. In this embodiment, the transmittance of the grayscale may be acquired in accordance with a transmittance-grayscale curve T=(Gray/((2^n)−1))^γ, wherein T represents the transmittance, Gray represents the grayscale, n represents the color level of the LCM, and γ represents a gamma value of the standard gamma curve.

The voltage V(G) of the predetermined grayscale may be obtained in accordance with the transmittance of the grayscale and the V-T curve shown in FIG. 9. A voltage V(min) corresponding to the lowest transmittance and a voltage V(max) corresponding to the highest transmittance may be acquired in accordance with the V-T curve. The center voltage Vcenter of the LCM may be calculated by the equation Vcenter=V(min)+V(Max) in accordance with the voltage V(min) corresponding to the lowest transmittance and the voltage V(max) corresponding to the highest transmittance. For example, when the grayscale value of the LCM is ranged from 0 to 63, the predetermined grayscales are 0, 1, 16, 32, 48, 62 and 63, and when the grayscale value of the LCM is ranged from 0 to 255, the predetermined grayscales are 0, 4, 60, 124, 188, 251 and 255.

Step 703: generating, by the PC, the gamma voltages applied to the LCM in accordance with the center voltage Vcenter of the LCM and the voltage V(G) of the predetermined grayscale. In this embodiment, the gamma voltages applied to the LCM may be calculated by the equation V(m)=Vcenter±V(G), wherein V(m) represents the gamma voltages applied to the LCM (for different products, it includes but not limited to 10, 14 or 18 gamma voltages), Vcenter represents the center voltage of the LCM, and V(G) represents the voltage of the predetermined grayscale.

Step 704: acquiring, by the PC, the to-be-adjusted common electrode voltage VCOM to be applied to the LCM. VCOM may be calculated by the equation VCOM=[V(max)−V(min)]/2, wherein V(min) represents an absolute grayscale voltage of the minimum grayscale of the LCM, and V(max) represents an absolute grayscale voltage of the maximum grayscale of the LCM. For example, for a twisted nematic (TN) product, VCOM=[V(0)−V(255 or 63)]/2, while for an ADS product, VCOM=[V(255 or 63)−V(0)]/2.

Step 705: applying, by the PC, the generated gamma voltages and VCOM to the gamma voltage generator. In this embodiment, the PC may support 18 gamma voltages and 2 common electrode voltages. In addition, the PC may be connected to the gamma voltage generator via a USB port.

Step 706: processing, by the gamma voltage generator, the gamma voltages and VCOM from the PC to obtain the to-be-adjusted gamma voltages and to-be-adjusted common electrode voltages, and then applying them to the LCM.

In this embodiment, the gamma voltage generator may be integrated with a decoding digital-to-analogue converter (DAC) that supports a USB protocol, so as to decode the USB-coded gamma voltages and VCOM from the PC. Meanwhile, the gamma voltage generator may also support the output of at most 18 gamma voltages and 2 common electrode voltages. The gamma voltage generator which outputs the to-be-adjusted gamma voltage and the to-be-adjusted common electrode voltage may be connected to a driver board of the LCM through a jig.

Step 707: controlling, by the PC, the pattern generator so as to output a flicker pattern to the LCM. In this embodiment, the PC may be connected to the pattern generator via a DB9 interface, and controls the pattern generator so as to output the flicker pattern to the LCM. For different driving modes, the flicker patterns may be different. The pattern generator may be connected to the LCM via a data line.

Step 708: processing, by the data collector, the flicker light intensity collected by the photodetector to obtain the second light intensity data, and then transmitting it to the PC. In this embodiment, the flicker light intensity collected by the photodetector is an analogue signal. The data collector may convert it to a digital signal, encodes the digital signal with the USB protocol to obtain the second light intensity data, and report it to the PC via the USB port.

Step 709: comparing, by the PC, the second light intensity data reported by the data collector with a light intensity data range of the standard flicker pattern, judging whether or not the second light intensity data is located within the light intensity data range of the standard flicker pattern, if yes, determining the to-be-adjusted VCOM voltage currently applied to the LCM as the reference VCOM voltage and proceeding to step 713, and otherwise, proceeding to step 710. The LCMs produced by different manufacturers have different light intensity data ranges of the standard flicker pattern, and the PC may provide a user interface (UI) so as to configure the light intensity data range of the standard flicker pattern.

Step 710: increasing or decreasing, by the PC, the to-be-adjusted VCOM voltage currently applied to the LCM by a first step value, so as to obtain a new to-be-adjusted VCOM voltage.

Step 711: judging, by the PC, whether or not the second light intensity data collected by the data collector after the new to-be-adjusted VCOM voltage is applied to the LCM is improved (e.g., whether or not a difference between the second light intensity data collected by the data collector after the new to-be-adjusted VCOM voltage is applied to the LCM and the light intensity data range of the standard flicker pattern is less than a difference between the second light intensity data collected preciously and the light intensity data range of the standard flicker pattern), if yes, increasing or decreasing the to-be-adjusted VCOM voltage currently applied to the LCM by the first step value in a manner identical to the previous adjustment and returning to step 710, and otherwise, proceeding to step 712.

Step 712: increasing or decreasing, by the PC, the to-be-adjusted VCOM voltage currently applied to the LCM by the first step value in a manner contrary to the previous adjustment, and returning to step 710. In this embodiment, the first step value may have a minimum value of 20 mV/step.

Step 713: controlling, by the PC, the pattern generator to generate a grayscale test pattern and transmitting it to the LCM.

Step 714: acquiring, by the PC, first light intensity data collected by the data collector when the LCM displays the grayscale test pattern, and plotting a gamma curve in accordance with the first light intensity data.

To be specific, this step comprises: 1) acquiring maximum light intensity data and minimum light intensity data when the LCM displays a maximum grayscale test pattern and a minimum grayscale test pattern, respectively; 2) acquiring a vertical coordinate data of the testing gamma curve by the following equation: the vertical coordinate data=the minimum light intensity data+(the maximum light intensity data−the minimum light intensity data)*(a grayscale of a current grayscale test pattern/a maximum grayscale corresponding to the maximum grayscale test pattern)^γ, wherein γ represents the gamma value of the standard gamma curve; and 3) plotting the testing gamma curve in accordance with the vertical coordinate data, wherein a horizontal coordinate data of the gamma curve representing a grayscale value range of the display module.

Step 715: comparing, by the PC, the testing gamma curve and the standard gamma curve, if the testing gamma curve is located within an acceptable range of the standard gamma curve, proceeding to step 717, and otherwise, proceeding to step 716.

Figure 10:
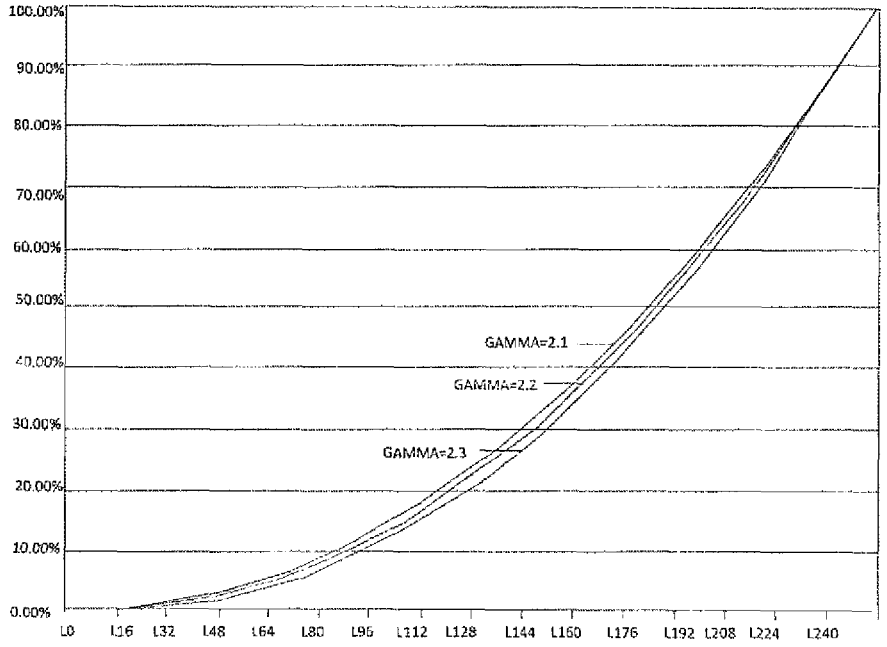
FIG. 10 is a schematic view showing a standard gamma curve according to the eighth embodiment of the present invention.

Referring to FIG. 10, which is a schematic view showing the standard gamma curve according to the embodiment of the present invention, wherein the standard gamma curve may have a gamma value of 2.1, 2.2, or 2.3.

Step 716: determining a gamma voltage Vi corresponding to an abnormal grayscale Gray, increasing or decreasing Vi by a second step value to obtain a new to-be-adjusted gamma voltage, and then returning to step 713. The correspondence Gray=2^n*f(Vi)^(1/γ) between the grayscale Gray and the gamma voltage Vi may be obtained according to a voltage-transmittance curve T=f(Vi) and a transmittance-grayscale curve T−(Gray((2^n)−1))^γ, wherein n represents a color level of the LCM.

In this embodiment, the gamma voltage Vi corresponding to the abnormal grayscale Gray may be determined by looking up a correspondence table showing the gamma voltage and the grayscale in FIG. 9 (the correspondence table obtained in accordance with Gray=2^n*f(Vi)^(1/γ)).

The method for looking up the correspondence table showing the gamma voltage and the grayscale will be described hereinafter.

For an 8-bit LCM, if the light intensity data of G63 on the testing gamma curve is less than the light intensity data of G63 on the standard gamma curve, it is required to increase the brightness of G63. As shown in FIG. 9, G63 is located between G61 and G124 corresponding to node voltages V4 and V11, respectively. If the LCM is a TN product, it is required to decrease V4 and V11 so as to increase the brightness of G63, and if the LCM is an ADS product, it is required to decrease V4 and V11 so as to increase the brightness of G63.

In addition, for an LCM with a normally white mode or a normally black mode, the methods for adjusting Vi may be different. For the LCM with the normally white mode, if a point on the testing gamma curve corresponding to Gray is located above a point on the standard gamma curve corresponding to Gray, Vi will be increased by the second step value, until the point on the testing gamma curve corresponding to Gray is located within the acceptable range of the standard gamma curve. For the LCM with the normally black mode, the voltage will be adjusted in a contrary manner. In this embodiment, the second step value may be 20 mV/step.

Step 717: determining, by the PC, the to-be-adjusted gamma voltage currently applied to the LCM as a final gamma voltage.

The above are merely the preferred embodiments of the present invention. It should be appreciated that, a person skilled in the art may further make improvements and modifications without departing from the principle of the present invention, and these improvements and modifications shall also be considered as the scope of the present invention.

What is claimed is:

1. A method for adjusting a gamma voltage, comprising:

acquiring transmittance of a predetermined grayscale in accordance with a transmittance-grayscale curve of a display module T=(Gray/((2^n)−1))^ γ, wherein T represents the transmittance, Gray represents the grayscale, n represents a color level of the display module, and γ represents a gamma value of a standard gamma curve;

acquiring a voltage of the predetermined grayscale in accordance with the transmittance of the predetermined grayscale and a voltage-transmittance curve of the display module;

acquiring a voltage corresponding to the lowest transmittance and a voltage corresponding to the highest transmittance in accordance with the voltage-transmittance curve of the display module, and calculating a sum of the voltage corresponding to the lowest transmittance and the voltage corresponding to the highest transmittance, so as to obtain a center voltage of the display module;

generating a to-be-adjusted gamma voltage in accordance with the voltage of the predetermined grayscale and the center voltage;

applying a reference common electrode voltage and the to-be-adjusted gamma voltage to a display module;

collecting first light intensity data when the display module displays a grayscale test pattern after the reference common electrode voltage and the to-be-adjusted gamma voltage are applied;

plotting a testing gamma curve in accordance with the first light intensity data;

judging whether or not the testing gamma curve is located within an acceptable range of a standard gamma curve;

when the testing gamma curve is not located within the acceptable range of the standard gamma curve, adjusting the to-be-adjusted gamma voltage currently applied to the display module, until the testing gamma curve is located within the acceptable range of the standard gamma curve; and when the testing gamma curve is located within the acceptable range of the standard gamma curve, determining the to-be-adjusted gamma voltage currently applied to the display module as a final gamma voltage.

2. The method according to claim 1, wherein prior to the step of applying the reference common electrode voltage and the to-be-adjusted gamma voltage to the display module, the method further comprises:

applying a to-be-adjusted common electrode voltage and the to-be-adjusted gamma voltage to the display module;

collecting second light intensity data when the display module displays a flicker pattern after the to-be-adjusted common electrode voltage and the to-be-adjusted gamma voltage are applied;

judging whether or not the second light intensity data is located within a light intensity data range of a standard flicker pattern;

when the second light intensity data is not located within the light intensity data range of the standard flicker pattern, adjusting the to-be-adjusted common electrode voltage currently applied to the display module, until the second light intensity data is located within the light intensity data range of the standard flicker pattern; and when the second light intensity data is located within the light intensity data range of the standard flicker pattern, determining the to-be-adjusted common electrode voltage currently applied to the display module as the reference common electrode voltage.

3. The method according to claim 2, wherein prior to the step of applying the to-be-adjusting common electrode and the to-be-adjusted gamma voltage to the display module, the method further comprises:

acquiring the to-be-adjusted common electrode voltage by the equation VCOM=[V(max)−V(min)]/2, wherein VCOM represents the to-be-adjusted common electrode voltage, V(min) represents an absolute grayscale voltage of a minimum grayscale of the display module, and V(max) represents an absolute grayscale voltage of a maximum grayscale of the display module.

4. The method according to claim 2, wherein the step of adjusting the to-be-adjusted common electrode voltage currently applied to the display module comprises:

increasing or decreasing the to-be-adjusted common electrode voltage currently applied to the display module by a first step value, to obtain a new to-be-adjusted common electrode voltage;

collecting the second light intensity data when the display module displays the flicker pattern after the new to-be-adjusted common electrode voltage and the to-be-adjusted gamma voltage are applied;

judging whether or not the second light intensity data collected currently is located within the light intensity data range of the standard flicker pattern;

when the second light intensity data collected currently is not within the light intensity data range of the standard flicker pattern, judging whether or not a difference between the second light intensity data collected currently and the light intensity data range of the standard flicker pattern is less than a difference between the second light intensity data collected previously and the light intensity data range of the standard flicker pattern, if yes, increasing or decreasing the to-be-adjusted common electrode voltage currently applied to the display module by the first step value in a manner identical to the previous adjustment, and if not, increasing or decreasing the to-be-adjusted common electrode voltage currently applied to the display module by the first step value in a manner contrary to the previous adjustment; and when the second light intensity data collected currently is located within the light intensity data range of the standard flicker pattern, determining the to-be-adjusted common electrode voltage currently applied to the display module as the reference common electrode voltage.

5. The method according to claim 1, wherein the step of plotting the gamma curve in accordance with the first light intensity data comprises:

acquiring maximum light intensity data and minimum light intensity data when the display module displays a maximum grayscale testing pattern and a minimum grayscale testing pattern;

acquiring a vertical coordinate data of the testing gamma curve by the following equation: the vertical coordinate data=the minimum light intensity data+(the maximum light intensity data−the minimum light intensity data) *(a grayscale of a current grayscale testing pattern/a maximum grayscale corresponding to the maximum grayscale testing pattern)^γ, wherein γ represents the gamma value of the standard gamma curve; and plotting the testing gamma curve in accordance with the Y-axis coordinate data, an X-axis coordinate data of the gamma curve representing a grayscale value range of the display module.

6. The method according to claim 1, wherein the step of adjusting the to-be-adjusted gamma voltage currently applied to the display module comprises:

acquiring an abnormal grayscale corresponding to a point on the testing gamma curve that is not located within the acceptable range of the standard gamma curve;

acquiring an abnormal to-be-adjusted gamma voltage corresponding to the abnormal grayscale;

increasing or decreasing the abnormal to-be-adjusted gamma voltage by a second step value, to obtain a new to-be-adjusted gamma voltage;

collecting the first light intensity data when the display module displays the grayscale testing pattern after the reference common electrode voltage and the new to-be-adjusted gamma voltage are applied;

plotting the testing gamma curve in accordance with the first light intensity data collected currently;

judging whether or not the testing gamma curve plotted currently is located within the acceptable range of the standard gamma curve;

when the testing gamma curve plotted currently is not located within the acceptable range of the standard gamma curve, continuing to adjust the abnormal to-be-adjusted gamma voltage, until the testing gamma curve plotted currently is located within the acceptable range of the standard gamma curve; and when the testing gamma curve plotted currently is located within the acceptable range of the standard gamma curve, determining the to-be-adjusted gamma voltage currently applied to the display module as the final gamma voltage.

7. A system for adjusting a gamma voltage, comprising:

a first applying unit configured to apply a reference common electrode voltage and a to-be-adjusted gamma voltage to a display module;

a first collecting unit configured to collect first light intensity data when the display module displays a grayscale test pattern after the reference common electrode voltage and the to-be-adjusted gamma voltage are applied;

a plotting unit configured to plot a testing gamma curve in accordance with the first light intensity data;

a first judging unit configured to judge whether or not the testing gamma curve is Located within an acceptable range of a standard gamma curve;

a gamma voltage adjusting unit configured to, when the testing gamma curve is not located within the acceptable range of the standard gamma curve, adjust the to-be-adjusted gamma voltage currently applied to the display module, until the testing gamma curve is Located within the acceptable range of the standard gamma curve;

a gamma voltage determining unit configured to, when the testing gamma curve is located within the acceptable range of the standard gamma curve, determining the to-be-adjusted gamma voltage currently applied to the display module as a final gamma voltage;

a transmittance acquiring unit configured to acquire the transmittance of a predetermined grayscale in accordance with a transmittance-grayscale curve of the display module $T=(Gray/((2^n)-1))^\gamma$, wherein T represents the transmittance, Gray represents the grayscale, n represents a color level of the display module, and $\gamma$ represents a gamma value of a standard gamma curve;

a voltage acquiring unit configured to acquire a voltage of the predetermined grayscale in accordance with the transmittance of the predetermined grayscale and a voltage-transmittance curve of the display module;

a center voltage acquiring unit configured to acquire a voltage corresponding to the lowest transmittance and a voltage corresponding to the highest transmittance in accordance with the voltage-transmittance curve of the display module, and calculate a sum of the voltage corresponding to the lowest transmittance and the voltage corresponding to the highest transmittance, so as to obtain a center voltage of the display module; and a gamma voltage generating unit configured to generate the to-be-adjusted gamma voltage in accordance with the voltage of the predetermined grayscale and the center voltage.

8. The system according to claim 7, further comprising:

a second applying unit configured to apply a to-be-adjusted common electrode voltage and the to-be-adjusted gamma voltage to the display module;

a second collecting unit configured to collect second light intensity data when the display module displays a flicker pattern after the to-be-adjusted common electrode voltage and the to-be-adjusted gamma voltage are applied;

a second judging unit configured to judge whether or not the second light intensity data is located within a light intensity data range of a standard flicker pattern;

a common electrode voltage adjusting unit configured to, when the second light intensity data is not located within the light intensity data range of the standard flicker pattern, adjust the to-be-adjusted common electrode voltage currently applied to the display module, until the second light intensity data is located within the light intensity data range of the standard flicker pattern; and a common electrode voltage determining unit configured to, when the second light intensity data is located within the light intensity data range of the standard flicker pattern, determine the to-be-adjusted common electrode voltage currently applied to the display module as the reference common electrode voltage.

9. The system according to claim 8, further comprising:

an initial common electrode voltage acquiring unit configured to acquire the to-be-adjusted common electrode voltage by the equation $VCOM=[V(max)-V(min)]/2$, wherein VCOM represents the to-be-adjusted common electrode voltage, V(min) represents an absolute grayscale voltage of a minimum grayscale of the display module, and V(max) represents an absolute grayscale voltage of a maximum grayscale of the display module.

10. The system according to claim 8, further comprising:

a transmittance acquiring unit configured to acquire the transmittance of a predetermined grayscale in accordance with a transmittance-grayscale curve of the display module $T=(Gray/((2^n)-1))^\gamma$, wherein T represents the transmittance, Gray represents the grayscale, n represents a color level of the display module, and $\gamma$ represents a gamma value of a standard gamma curve;

a voltage acquiring unit configured to acquire a voltage of the predetermined grayscale in accordance with the transmittance of the predetermined grayscale and a voltage-transmittance curve of the display module;

a center voltage acquiring unit configured to acquire a voltage corresponding to the lowest transmittance and a voltage corresponding to the highest transmittance in accordance with the voltage-transmittance curve of the display module, and calculate a sum of the voltage corresponding to the lowest transmittance and the voltage corresponding to the highest transmittance, so as to obtain a center voltage of the display module; and a gamma voltage generating unit configured to generate the to-be-adjusted gamma voltage in accordance with the voltage of the predetermined grayscale and the center voltage.

11. The system according to claim 8, wherein the common electrode voltage adjusting unit comprises:

a first adjusting sub-unit configured to increase or decrease the to-be-adjusted common electrode voltage currently applied to the display module by a first step value, to obtain a new to-be-adjusted common electrode voltage, and transmit the new to-be-adjusted common electrode voltage to the first applying unit;

a first judging sub-unit configured to judge whether or not the second light intensity data collected currently when the display module displays the flicker pattern after the new to-be-adjusted common electrode voltage and the to-be-adjusted gamma voltage are applied is located within the light intensity data range of the standard flicker pattern;

a second adjusting sub-unit configured to, when the second light intensity data collected currently is not within the light intensity data range of the standard flicker pattern, judge whether or not a difference between the second light intensity data collected currently and the light intensity data range of the standard flicker pattern is less than a difference between the second light intensity data collected previously and the light intensity data range of the standard flicker pattern, if yes, increase or decrease the to-be-adjusted common electrode voltage currently applied to the display module by the first step value in a manner identical to the previous adjustment, and if not, increase or decrease the to-be-adjusted common electrode voltage currently applied to the display module by the first step value in a manner contrary to the previous adjustment; and a first determining sub-unit configured to, when the second light intensity data collected currently is located within the light intensity data range of the standard flicker pattern, determine the to-be-adjusted common electrode voltage currently applied to the display module as the reference common electrode voltage.

12. The system according to claim 7, wherein the plotting unit comprises:

a first acquiring sub-unit configured to acquire maximum light intensity data and minimum light intensity data when the display module displays a maximum grayscale testing pattern and a minimum grayscale testing pattern;

a second acquiring sub-unit configured to acquire a vertical coordinate data of the testing gamma curve by the following equation: the vertical coordinate data=the minimum light intensity data+(the maximum light intensity data−the minimum light intensity data)*(a grayscale of a current grayscale testing pattern/a maximum grayscale corresponding to the maximum grayscale testing pattern)^γ, wherein γ represents the gamma value of the standard gamma curve; and a first plotting sub-unit configured to plot the testing gamma curve in accordance with the vertical coordinate data, wherein a horizontal coordinate data of the gamma curve represents a grayscale value range of the display module.

13. The system according to claim 7, wherein the gamma voltage adjusting unit comprises:

a third acquiring sub-unit configured to acquire an abnormal grayscale corresponding to a point on the testing gamma curve that is not located within the acceptable range of the standard gamma curve;

a fourth acquiring sub-unit configured to acquire an abnormal to-be-adjusted gamma voltage corresponding to the abnormal grayscale;

a third adjusting sub-unit configured to increase or decrease the abnormal to-be-adjusted gamma voltage by a second step value to obtain a new to-be-adjusted gamma voltage, and transmit the new to-be-adjusted gamma voltage to the first applying unit;

a second plotting sub-unit configured to plot the testing gamma curve in accordance with the first light intensity data collected when the display module displays the grayscale testing pattern after the reference common electrode voltage and the new to-be-adjusted gamma voltage are applied;

a second judging sub-unit configured to judge whether or not the testing gamma curve plotted currently is located within the acceptable range of the standard gamma curve;

a fourth adjusting sub-unit configured to, when the testing gamma curve plotted currently is not located within the acceptable range of the standard gamma curve, continue to adjust the abnormal to-be-adjusted gamma voltage, until the testing gamma curve plotted currently is located within the acceptable range of the standard gamma curve; and a second determining sub-unit configured to, when the testing gamma curve plotted currently is located within the acceptable range of the standard gamma curve, determine the to-be-adjusted gamma voltage currently applied to the display module as the final gamma voltage.

14. An electronic device comprising the system for adjusting a gamma voltage according to claim 7.

* * * * *